United States Patent [19]

Ernst

[11] 4,377,338

[45] Mar. 22, 1983

[54] METHOD AND APPARATUS FOR COPIER QUALITY MONITORING AND CONTROL

[75] Inventor: Larry M. Ernst, Boulder, Colo.

[73] Assignee: International Business Machines Corporation, Armonk, N.Y.

[21] Appl. No.: 291,136

[22] Filed: Aug. 7, 1981

[51] Int. Cl.[3] ..... G03G 15/00

[52] U.S. Cl. ..... 355/14 D; 355/3 DD; 118/663; 118/688; 118/691

[58] Field of Search ..... 355/3 DD, 3 CH, 3 R, 355/3 TR, 14 D, 14 R, 14 TR, 77; 118/688, 689, 663

[56] References Cited

U.S. PATENT DOCUMENTS

| | | | |
|---|---|---|---|
| 3,872,825 | 3/1975 | Davidson | 355/3 DD X |
| 4,153,364 | 5/1979 | Suzuki et al. | 355/14 D X |
| 4,178,095 | 12/1979 | Champion et al. | 355/14 R |
| 4,183,657 | 1/1980 | Ernst et al. | 355/14 R |
| 4,239,372 | 12/1980 | Iwai | 355/14 D X |
| 4,272,182 | 6/1981 | Abe et al. | 355/3 DD X |
| 4,273,843 | 6/1981 | Fujita et al. | 355/3 DD X |
| 4,277,162 | 7/1981 | Kasahara et al. | 355/14 D X |
| 4,313,671 | 2/1982 | Kuru | 355/3 DD X |

OTHER PUBLICATIONS

IBM Technical Disclosure Bulletin, vol. 22, No. 8B, Jan. 1980, (p. 3606), entitled "Copier Adjustment", by B. A. Nilsson.

*Primary Examiner*—A. C. Prescott
*Attorney, Agent, or Firm*—Earl C. Hancock

[57] ABSTRACT

Data correlated to the light reflectance of a maximum toned area and a minimum toned area is recorded to establish standards for monitoring and controlling subsequent copier operation. A test pattern is imaged onto the photoconductor by controlled illumination levels in a series of steps with the detection of light reflectance from that test pattern being subsequently compared to establish the maximum black and maximum white criteria for storage. Light reflected from cleaned photoconductor areas and subsequently established toner patches then are used to compare against the original test pattern reflectance data. Toner replenishment, controls and machine function monitoring (e.g.: white copy background, developer operation, etc.) are based on these recorded standards from the test pattern.

10 Claims, 4 Drawing Figures

METHOD AND APPARATUS FOR COPIER QUALITY MONITORING AND CONTROL

TECHNICAL FIELD

The present invention relates to methods and apparatus for monitoring the quality of operation of a copier. More particularly, the present invention relates to methods and apparatus for monitoring the amount of toner applied to a photoconductor surface and for providing control responses based upon the monitored data. The invention is particularly useful for controlling such copier functions as toner level in the developer, toner replenishment to the developer, adjustment of illumination lamp levels, adjustment of biasing voltage levels and the like, based upon dynamic standards.

BACKGROUND ART

Contemporary xerographic copiers often employ so-called patch sensing techniques for monitoring the level of toner in the developer. These systems establish a test pattern by discharging the photoconductor everywhere except in a discrete path or stripe and thereafter monitoring the light reflectivity of both the cleaned photoconductor and the patch. Such patches are either placed in the area of the photoconductor outside of the image areas so as not to delay copying operations or are performed by a special cycle to establish the patch in the image area and to test its reflectivity. An unsatisfactory light reflectivity of the patch area causes a response in the form of increased toner introduction or replenishment from a reservoir to a developer sump. A system for performing such an operation is shown in U.S. Pat. No. 4,178,095 by J. R. Champion and S. D. Seigal which issued on Dec. 11, 1979 and is assigned to the same assignee as the present application.

Another process for monitoring machine operation is suggested in the *IBM Technical Disclosure Bulletin* of January 1980 (Vol. 22 No. 8B) at pages 3606–3608 in the article entitled "Copier Adjustment" by B. A. Nilsson. This article suggests controlled introduction of gray to white transition bands on a copier during servicing so that the servicing user can compare these bands as transferred and fused on a copy sheet against a standard for a satisfactorily operating machine. The service person can then make appropriate adjustments based upon the result.

However, the prior art has not suggested that the operation of a copier is monitorable by establishing a series of light to dark transition bands on the photoconductor upon initialization of the machine, and subsequently comparing toned patches from the photoconductor with those bands so as to dynamically determine the status and appropriate responses to the machine operation.

DISCLOSURE OF THE INVENTION

The present invention relates to methods and apparatus for establishing toner level standards for a copier. Such copiers employ a moving photoconductor which is charged for receiving an electrostatic image of an original document or the like. A lamp illuminates the photoconductor and a developer applies toner to the photoconductor. In its preferred embodiments, the present invention is particularly well suited for use in conjunction with reflected light measuring devices associated with the photoconductor.

In the copier environment mentioned above, the process in accordance with the present invention includes charging the photoconductor to a normal level for accepting images. The lamp and developer are controlled for selectively creating sequential areas on the photoconductor ranging from an area of maximum toner application to an area of minimum toner application. The output of the measuring device is sensed where this output indicates light reflected from the photoconductor sequential areas mentioned above as they pass the measuring device. Signals are then stored corresponding to the reflected light measurement output correlated to the sequential areas of toner application on the photoconductor. This process makes it possible to at least partially determine the operation of the copier by subsequent comparisons of the reflected light output with the stored signals.

One step for establishing the sequential areas of toner application on the photoconductor is to vary the power to the illumination lamp from a maximum brightness to a lamp-off condition. In addition, subsequent reflected light output signals are comparable with the stored signals and the copier operation is adjustable in accordance with the difference between those signals. One application of this adjustment is to add toner to the developer in proportion to the difference between the compared signals. It is also possible to control operation of the reflecting or measuring means output for subsequent signal determinations so as to accommodate changes in the photoconductor reflectance as occurs from usage. Yet another application of the results of the comparison of subsequent signals is to control the intensity of the illumination lamp in accordance with the difference between the signals.

Apparatus for implementing the present invention includes circuitry having a comparator with the reflected light sensing output coupled to one input and a power source responsive to an input for appplying selectable power levels to the illumination lamp. The circuitry includes a controller with means for producing first and second output signals of selectable magnitudes, the first output being used to control the power source at its input and the second output providing the second input to the comparator. The control further includes means for storing data correlated to signals at the comparator output terminal and a sequencer which further includes means energizing the controller first output to cause the lamp to produce light in a sequence between a maximum intensity and a reduced or off condition so as to place an image test pattern on the photoconductor. The sequencer further includes means operable in response to the output signal of the reflected light responsive means caused by the photoconductor test pattern for varying the second output signal until the comparator output indicates a favorable comparison result. The sequencer then is able to use means to enable the storing means to store data correlated to at least the maximum and minimum levels of the favorable comparison results.

The sequencer can further include means operable subsequent to the storage of the data in the storing means relating to the test pattern for actuating the first and second output producing means and means for comparing the signal from the comparator output terminal with the data stored in the storing means. The apparatus can further include means to adjust the first signal output of the controller to the power source for the illumination lamp to accommodate changes in reflectivity of the photoconductor. The apparatus is adaptable to employ the response from the comparing means output indicating that inadequate toner is present on the photoconductor to cause toner replenishment in the developer. Other utilizations of the comparison result are readily apparent, such as for the purpose of controlling various bias voltage levels associated with the developers and/or coronas, flagging out-of-tolerance conditions to the operator, accelerated toner replenishment when a highly reduced toner level is determined and so forth.

The foregoing and other objects, features, advantages and applications of the present invention are readily apparent to those having normal skill in the art from the following more detailed description of the preferred embodiments as illustrated in the accompanying drawings.

DETAILED DESCRIPTION OF THE PREFERRED EMBODIMENT

Figure 1:
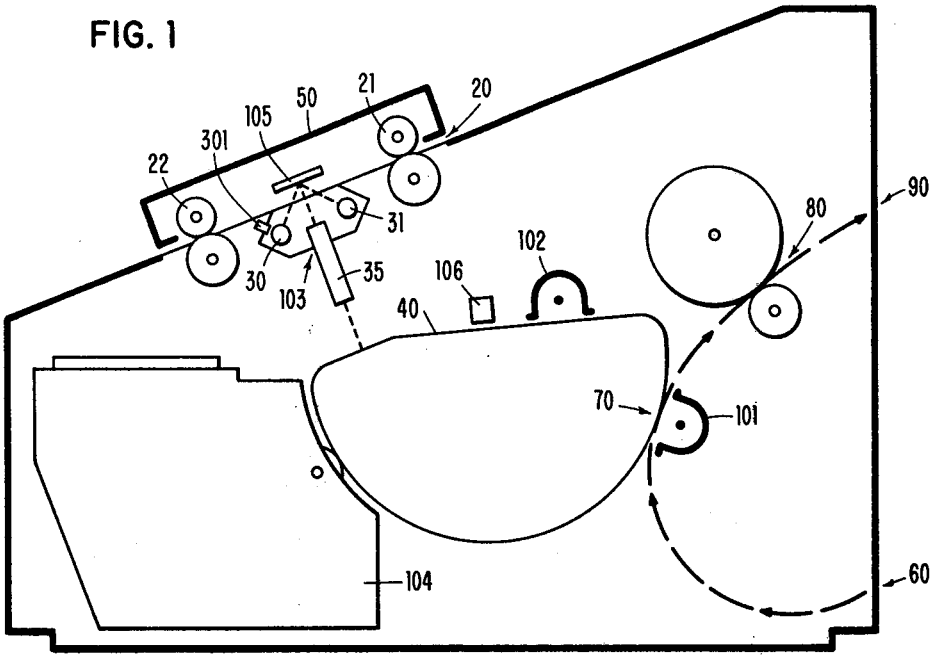
FIG. 1 is a side, simplified view of a xerographic-type copier in which the present invention is useful.

The general organization of elements associated with the xerographic processing of copies in a contemporary copier is shown in the side view of FIG. 1. A continuing concern relative to such copiers is the insurance of copy quality in the form of clear differentiation between black and white areas of the documents being copied. The original documents serially introduced at entryway 20 are driven by roller pairs 21 and 22 past the scan window where they are illuminated by lamps 30 and 31 so that a fiber optic bundle 35 can direct the image onto a photoconductive belt around capstan 40. The upper cover 50 is shown pivotable to allow passage of large documents, books or objects over the scan window. Copy sheets from a supply (not shown) are introduced at 60 and receive their image at transfer station 70. These copy sheets are subsequently passed through fuser 80 and are delivered at exit 90.

The basic operation of the copier is such that the precharge corona 101 charges the photoconductor belt on capstan 40 to about −1200 volts. Charge corona 102 drives the photoconductor positive to about −870 volts. The optic system 103 introduces a latent electrostatic image on the photoconductor where the black areas on the photoconductor are about −850 volts and the white areas are about −225 volts. Developer 104 adheres toner particles to the highly negative areas on the photoconductor.

On the second revolution, corona 101 acts as a transfer corona causing toner to be removed from the photoconductor to the copy paper introduced at 60.

Next corona 102 acts as a clean corona to drive the photoconductor voltage to about zero and to ensure all residual tone particles are positive. Mirror 105 in housing 50 allows light from the optic system 103 to act as an erase system. Residual toner on the photoconductor is then preconditioned so the developer 104 acts as a cleaner. The machine is thus ready to make another copy. The operation described is known as the two-cycle copy process although the present invention is also useful in other copier environments.

Figure 3:
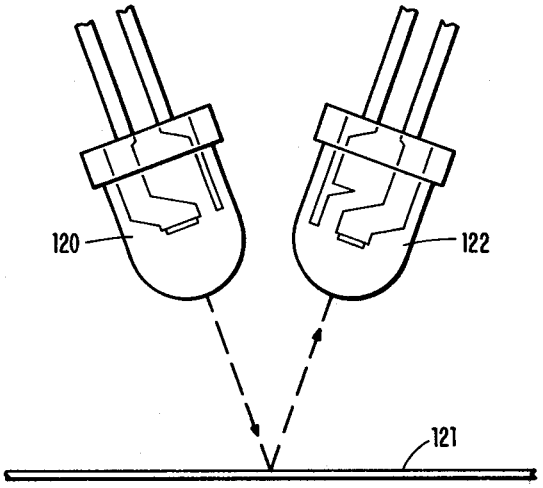
FIG. 3 is a simplified view of a light source and reflected light detector combination.
Figure 4:
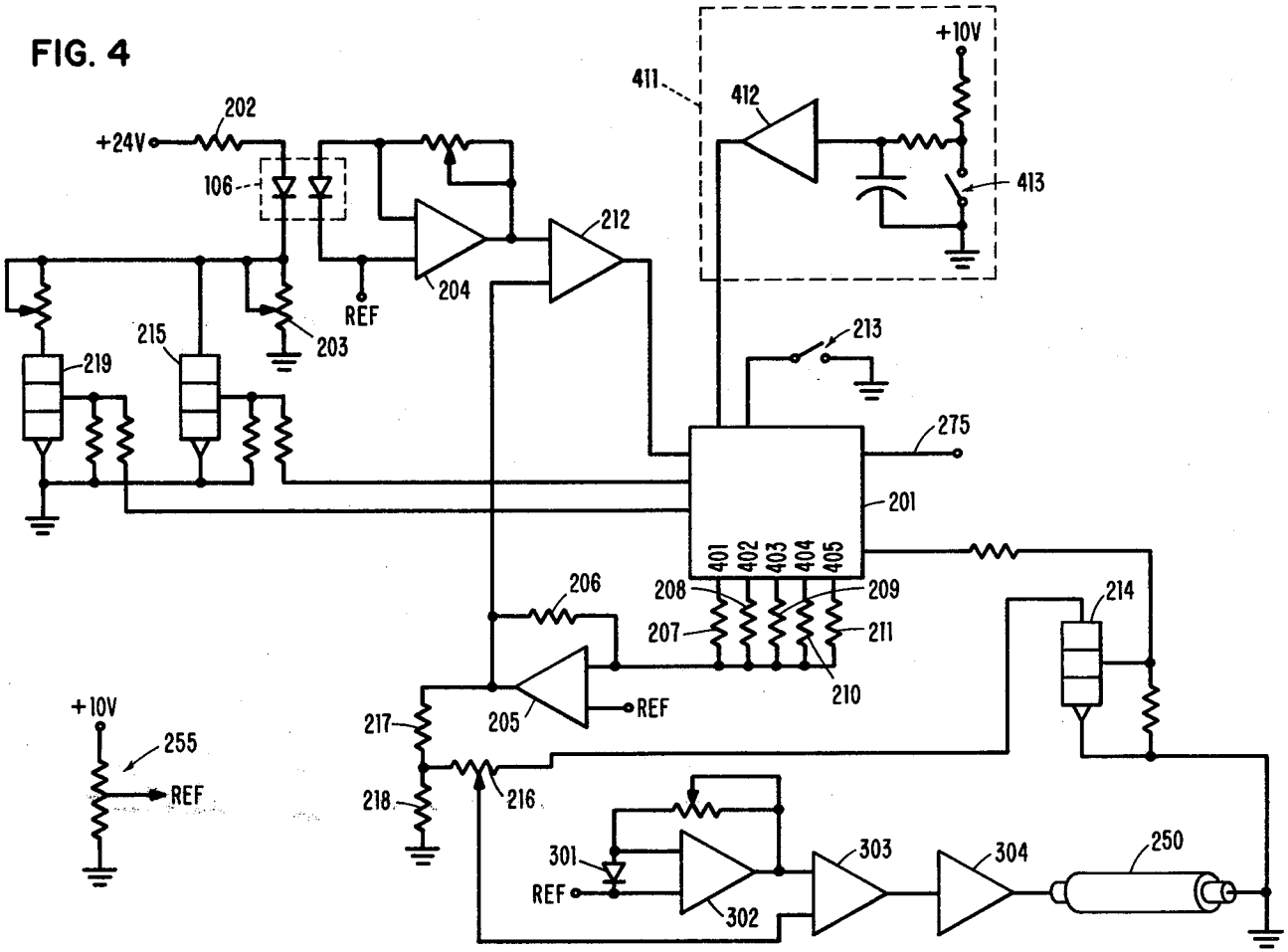
FIG. 4 is a schematic diagram of the control circuitry associated with copier controls in accordance with the present invention.

The necessary conditions for ensuring control of the electrophotographic process are next considered. It is necessary that a fixed amount of toner is applied to the photoconductor when the photoconductor is at its maximum negative potential. It is also important to ensure minimum amount of toner is applied in the minimum negative potential areas. To help perform this function, sensor 106 is added. FIG. 3 shows diagrammatically the elements of sensor 106 which is comprised of a light emitting diode 120 which is directed towards the photoconductor belt 121 and thus produces light reflected towards a photodetector or solar cell 102. FIG. 4 shows the electronics associated with operation of the sensor 106.

When the machine is initially turned on, the microcontroller 201 determines the output voltage of operational amplifier 204 when sensor 106 is detecting light reflected from a clean photoconductor and current through the LED 120 in sensor 106 is determined by resistors 202 and 203. Microcontroller 201, operational amplifier 205, operational amplifier 212 and associated resistors 206, 207, 208, 209, 210 and 211 are connected as an analog-to-digital converter to perform the function of converting the output voltage of operational amplifier 204 to digital information for storage in microcontroller 201 memory. In a typical operating environment, microcontroller 201 is a conventional 4-bit product like the Nippon Electric Co. Ltd. (NEC) MPD 546C.

While the fuser is warming up in response to an intialization start by the operator, the machine performs the necessary functions to optimize its electrophotographic parameters as described below. The microcontroller 201 starts the main drive motor, and turns the high voltage power supplies on which drive coronas 101 and 102. The voltage on the photoconductor between coronas 101 and 102 is driven to about −1200 volts. The charge corona 102 with its grid at about −870 volts drives the photoconductor potential to about −870 volts. When the photoconductor leading edge of the image area is at optic station 103, microcontroller 201 turns the illumination lamp 250 off by causing the output of operational amplifier 205 to become greater than the reference voltage (REF) established by adjustable resistance network 255.

Figure 2:
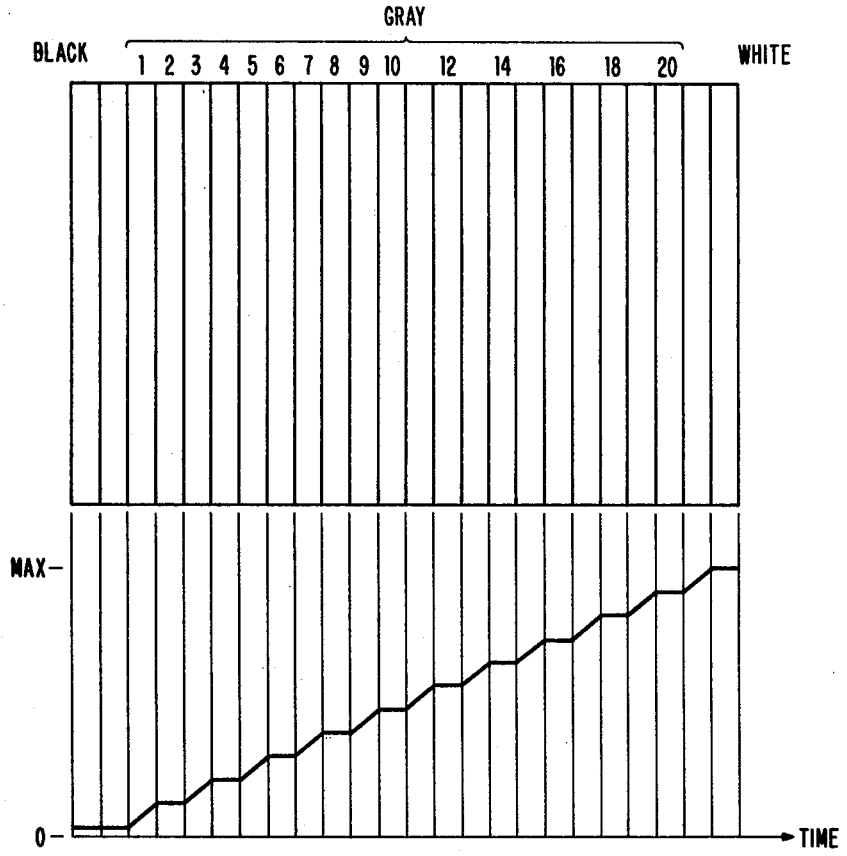
FIG. 2 is a chart of the black to white transition pattern recordings based upon varying illumination levels.

Next microcontroller 201 produces an electrostatic image as shown in FIG. 2 by decreasing the voltage output of operational amplifier 205 in equal steps when mirror 105 is in position. The reason the pattern of FIG. 2 is developed is because photodiode 301 is monitoring the illumination lamp level and as the voltage input to the positive terminal of operational amplifier 303 decreases (becomes more negative), the output of the illumination lamp 250 increases by a proportional amount since the photodiode 301 output current is proportional to light energy. Note that the illumination lamp 250 shown in FIG. 4 is the equivalent of both lamps 30 and 31 shown in FIG. 1. Note also that, as shown in FIG. 2, the odd numbered stripes (1, 3, 5, 7 . . . 19) are transition zones and are not at any defined level.

As the photoconductor passes through developer 104, a gray scale is produced on the photoconductor starting from an all-black and going through an all-white. As the photoconductor continues, corona 101 is off since paper is not being picked and also it is desirable not to change the polarity of the toner charge. Next the charge corona grid is at ground potential to help discharge the photoconductor and ensure the toner particles are positive.

The microcontroller 201 produces as an output the digital information concerning the clean photoconductor reference level on lines 401, 402, 403, 404 and 405 to produce the proper potential as an output of operational amplifier 205. The microcontroller turns transistor 215 on, increasing the current in the sensor 106 LED about the expected change in photoconductor reflectance which is about 10 volts. As the black stripe passes under sensor 106, the photoconductor reflectance level is compared with the stored level using operational amplifier 212 as a comparator. If the output of operational amplifier 212 is negative (i.e.: output of operational amplifier 204 more negative than output of operational amplifier 205), microcontroller 201 instructs the machine to add toner to the developer. Examples of metering roller operations and the like for introducing toner from a reservoir to a toner sump are shown in U.S. Pat. No. Re. 28,589 by A. H. Knight and M. J. Miller which is assigned to the same assignee as this application and also in the October 1968 *IBM Technical Disclosure Bulletin* in the article entitled "Toner Dispenser" by J. A. Machmer at pages 497–498. Also, the toner replenishment rate is controllable in proportion to the test patch reflectivity displacement as compared to the prior recorded gray zones.

Next microcontroller 201 turns transistor 215 off and turns transistor 219 on causing an increase in LED current of about 15% above the clean level. Microcontroller 201 looks at the developed gray stripes (the even numbered stripes in FIG. 2 of 2, 4, 8, 10 . . . 20). When controller 201 finds the first stripe which has a reflectance causing the output of operational amplifier 201 to be more negative than operational amplifier 205 output, microcontroller 201 records in memory the stripe number. By using a look-up table in memory, microcontroller 201 determines what the states of lines 401, 402, 403, 404 and 405 were on a previous cycle when the stripe was produced by optic system 103 in its controlled circuit of operational amplifiers 302, 303, 304 and associated components. The digital information is useful as a reference level to control various machine operations such as the light intensity of the illumination lamp 30 or 250. The photoconductor now continues around the proper number of times to remove all the toner from the surface of the photoconductor. The copier is then turned off and continues waiting until the fuser finishes warming up.

When an operator wants to improve the copy quality of the machine, the only adjustment is potentiometer 216. The only reason this is required is due to the fact that background of the original is not of the proper reflectance for optimum copy quality. The actual function of potentiometer 216 is a memory element to instruct the machine of the difference in its reflectance standard (mirror 105) and the reflectance of the original. Note when the machine is putting the electrostatic image on the photoconductor, transistor 214 is on. At all other times, transistor 214 is off, allowing the machine illumination to default to its clean level (light intensity to drive the photoconductor from black level to a voltage level corresponding to 15% background on the photoconductor with the mirror).

As the machine is used, it is necessary to update the electrophotographic parameters at the end of most jobs. This can be done after running a predetermined number of copies after the previous sample such as after more than 5 but less than 100 copies. It is suggested that, if a copy count goes to 100 without sampling, machine interruption to take a sample is mandatory. Instead of going through a detailed setup as described earlier, a similar process is used except the pattern is with a reduced number of gray stripes instead of the number shown in FIG. 2. The number of gray stripes included in the reduced sample includes the optimum gray stripe area and one or more additional stripes on either side thereof. The machine then updates its data accordingly.

If the machine does not include a separate button for initializing the parameter recording, the process described is performable automatically with the very first copy after the machine has turned on. One having normal skill in the art will realize there are many different implementations of the above concept which may appear to the casual operator totally different. For example, assume it is desirable to use some other substrate as determined by the casual operator for the reflectance standard instead of mirror 105. This is easily done by adding the circuitry shown in block 411. The purpose is to inform the machine of use of a different reflectance standard. The casual operator positions the potentiometer 216 in the center and closes switch 413. The microcontroller turns transistor 214 on and repeats the setup procedure described earlier.

The microcontroller is controlled by an emitter switch 213 associated with operation of the belt drive system. That is, these emitter pulses are used for synchronization purposes in a well-known manner. The output signal at terminal 275 is connected to the driving mechanism for the toner metering arrangement in the replenishing system.

Although the present invention has been described with particularity relative to the foregoing detailed description of the exemplary preferred embodiment, various modifications, changes, additions and applications of the present invention in addition to those mentioned herein will be readily apparent to those having normal skill in the art without departing from the spirit of this invention.

What is claimed is:

1. The method of establishing toner level standards for a copier which has a moving photoconductor, means for charging said photoconductor for receiving an electrostatic image, an illumination lamp arranged for illuminating said photoconductor, a developer for applying toner to said photoconductor and means for measuring light reflected from said photoconductor comprising the steps of:

charging said photoconductor for accepting images;

controlling said lamp and said developer for selectively creating sequential areas on said photoconductor ranging from an area of maximum toner application to an area of minimum toner application;

sensing the output of said measuring means where said output indicates light reflected from said photoconductor sequential areas as they pass said measuring means; and storing signals corresponding to said measuring means output correlated to said sequential areas on said photoconductor, whereby operation of said copier is at least partially determinable by subsequent comparisons of said measuring means output with said stored signals.

2. The method in accordance with claim 1 wherein said controlling step includes the step of varying power to said illumination lamp from maximum brightness to a lamp off condition.

3. The method in accordance with claim 1 which further includes the steps of:

comparing a subsequent said measuring means output signal with signals stored during said storing step; and adjusting operation of said copier in accordance with the difference between signals from said comparing step.

4. The method in accordance with claim 3 wherein said adjusting step includes the step of adding toner to said developer in proportion to the difference between said compared signals.

5. The method in accordance with claim 4 wherein said comparing step further includes the step of controlling said measuring means for compensating said subsequent measuring means output signal for changes in photoconductor reflectance.

6. The method in accordance with claim 3 which includes the step of adjusting the intensity of light from said illumination lamp in accordance with the difference between said compared signals.

7. In an apparatus for monitoring operation of a copier having a moving photoconductor, means for charging said photoconductor for electrostatic imaging, a lamp for illuminating said photoconductor, a developer for applying toner to said photoconductor and means responsive to light reflected from said photoconductor for producing an output signal correlated to the magnitude of said reflected light, an improvement comprising:

a comparator having said reflected light means output coupled as one input thereto and having an output terminal;

a power source responsive to an input for applying selectable power levels to said lamp; and a controller including:

(a) means for producing first and second output signals of selectable magnitudes with said first signal output coupled as said power source input and said second signal output coupled as a second input to said comparator;

(b) means for storing data correlated to signals at said comparator means output terminal; and (c) a sequencer having:

(i) means energizing said first output signal for causing said lamp to produce light in a sequence between a maximum intensity and an off condition so as to place an image test pattern on said photoconductor;

(ii) means operable in response to said output signal of said reflected light responsive means caused by said photoconductor test pattern for varying said second output signal until said comparator output indicates a favorable comparison result; and (iii) means enabling said storing means to store data correlated to at least the maximum and minimum levels of said favorable comparison results.

8. Apparatus in accordance with claim 7 wherein said sequencer includes means operable subsequent to storage of said data in said storing means for actuating said first and second output producing means, and means for comparing the signal from said comparator output terminal with said data stored in said storing means.

9. Apparatus in accordance with claim 8 wherein said subsequent operable means applies a said first signal output to said power source input for accommodating changes in reflectivity of said photoconductor.

10. Apparatus in accordance with claim 8 which includes:

means responsive to a said comparing means output indicative of inadequate toner on said photoconductor for adding toner to said developer.

* * * * *